US009517780B2

(12) United States Patent
Jung et al.

(10) Patent No.: US 9,517,780 B2
(45) Date of Patent: Dec. 13, 2016

(54) APPARATUS FOR CONTROLLING SPEED IN RAILWAY VEHICLES

(71) Applicant: LSIS CO., LTD., Anyang-si, Gyeonggi-do (KR)

(72) Inventors: Jongchul Jung, Seoul (KR); Yong Gee Cho, Seoul (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/538,109

(22) Filed: Nov. 11, 2014

(65) Prior Publication Data

US 2015/0142226 A1 May 21, 2015

(30) Foreign Application Priority Data

Nov. 15, 2013 (KR) ..... 10-2013-0138988

(51) Int. Cl.

| | |
|---|---|
| ***B61C 17/12*** | (2006.01) |
| ***B61L 27/00*** | (2006.01) |
| ***B61L 3/00*** | (2006.01) |
| *B61L 25/02* | (2006.01) |

(52) U.S. Cl.

CPC ..... *B61C 17/12* (2013.01); *B61L 3/008* (2013.01); *B61L 27/00* (2013.01); *B61L 25/021* (2013.01); *B61L 25/025* (2013.01)

(58) Field of Classification Search

CPC ..... B60L 11/1831; B61C 17/12; B61L 3/008
USPC ..... 701/20
See application file for complete search history.

(56) References Cited

U.S. PATENT DOCUMENTS

| | | | | |
|---|---|---|---|---|
| 4,858,135 | A * | 8/1989 | Clish | B60K 31/185 123/352 |
| 5,355,675 | A * | 10/1994 | Mayhugh | B66D 1/44 60/327 |
| 5,740,043 | A | 4/1998 | Wood et al. | |
| 5,983,144 | A * | 11/1999 | Bonissone | B60T 7/22 246/182 R |

(Continued)

FOREIGN PATENT DOCUMENTS

| | | |
|---|---|---|
| CN | 101320047 | 12/2008 |
| CN | 101992795 | 3/2011 |

(Continued)

OTHER PUBLICATIONS

Korean Intellectual Property Office Application Serial No. 10-2013-0138988, Office Action dated Jun. 25, 2015, 4 pages.

(Continued)

*Primary Examiner* — Behrang Badii
*Assistant Examiner* — Michael Berns
(74) *Attorney, Agent, or Firm* — Lee, Hong, Degerman, Kang & Waimey

(57) ABSTRACT

An apparatus for controlling speed in railway vehicles is disclosed, the apparatus estimates a future train speed and determines a control input (first speed control) configured to control a train speed based on a TTSLC {Time-To-Speed-Limit Crossing, a time taken by a train from a current time to exceed an ATP (Automatic Train Protection) speed profile, which is an ATP speed limit}, and determines a control input (second speed control) configured to control the train speed based on a difference between the ATP speed profile and an actual train speed, whereby the first speed control or the second speed control is selected in response to the TTSLC and outputted to the train.

6 Claims, 4 Drawing Sheets

(56) References Cited

U.S. PATENT DOCUMENTS

| | | | | |
|---|---|---|---|---|
| 6,760,712 | B1 * | 7/2004 | Bonissone | B61L 27/0055 701/19 |
| 2011/0046827 | A1 * | 2/2011 | Yoon | B61L 3/006 701/20 |
| 2013/0096741 | A1 * | 4/2013 | Jung | B61L 3/008 701/20 |

FOREIGN PATENT DOCUMENTS

| | | |
|---|---|---|
| CN | 103057553 | 4/2013 |
| KR | 10-1256315 | 4/2013 |

OTHER PUBLICATIONS

The State Intellectual Property Office of the People's Republic of China Application Serial No. 201410852793.X, Office Action dated Mar. 10, 2016, 9 pages.

* cited by examiner

APPARATUS FOR CONTROLLING SPEED IN RAILWAY VEHICLES

CROSS-REFERENCE TO RELATED APPLICATIONS

Pursuant to 35 U.S.C. §119(a), this application claims the benefit of earlier filing date and right of priority to Korean Patent Application No. 10-2013-0138988, filed on Nov. 15, 2013, the contents of which are all hereby incorporated by reference herein in its entirety.

BACKGROUND OF THE DISCLOSURE

Field of the Disclosure

The teachings in accordance with the exemplary embodiments of this present disclosure generally relate to an apparatus for controlling speed in railway vehicles, and more particularly to apparatus for controlling speed in railway vehicles in an automatic train operation system.

Discussion of the Related Art

This section provides background information related to the present disclosure which is not necessarily prior art.

In general, an object of automatic train operation (running) is to enable a train to run at a predetermined target speed at each operation section, and to effectively and safely stop at a designated position at a train station, and to efficiently and safely operate the train between stations.

The automatic train operation may be effected without a driver, and even if a driver is available, the driver is not proactively involved in the operation of a train, but provides a minimum part of performing a brake of the train when there is generated an emergency.

In case of a CBTC (Communication-Based Train Control) that is operated by radio communication, protection of train is performed by an ATP (Automatic Train Protection) system, and operations such as control of train speed and the like is performed by an ATO (Automatic Train Operation) system.

The ATP system sets up an ATP speed profile or ATP speed limit in consideration of various factors including a train speed limit at each section, stop position in response to movement authority and safety brake model. The speed limit is transmitted to the ATO system, where the ATO system generates an ATO speed profile in consideration of various factors such as ride comfort and adhesion coefficient, lest the train should exceed the limit.

Then, a controller measures a current speed and sends deceleration/acceleration commands to the train to follow the ATO speed profile generated by the train. Subsequently, the train runs in response to the generated ATO speed profile.

FIG. 1 is a graph illustrating control of a train speed according to prior art.

Referring to FIG. 1, T1 is a current time, Tw is a time when a train exceeds an ATP speed limit for warning, and T2 is a time when the train exceeds an ATP speed limit for emergency braking Although a train runs in response to the ATO speed profile (not shown), if the train exceeds the ATP speed profile or the ATP speed limit, the ATP system activates an emergency brake to eventually stop the train.

To be more specific, albeit being variable according to systems, the ATP speed limit is provided in two types, that is, one is the ATP speed limit for warning and the other is the ATP speed limit for emergency braking, and if the train exceeds the ATP speed limit for warning, the ATP system transmits warning to a driver or a supervisor. However, if the train speed exceeds the ATP speed limit for emergency braking, because no subsequent follow-up action is made in response to the transmitted warning, the train is stopped by the ATP system by activating the emergency braking.

That is, if the train is running at the train speed illustrated in FIG. 1, the ATP system transmits a warning signal to the driver or the supervisor at Tw, and transmits an emergency braking command to the train at T2, whereby the train is stopped by the emergency braking.

As noted from the foregoing, in the conventional automatic train operation system, the ATO generates an ATO speed profile based on the ATP-generated ATP speed limit, and transmits propulsive or braking command to enable a train to trace (follow) the ATO speed profile while not exceeding the ATP speed limit, whereby a train safety is guaranteed.

Thus, in the system like the above, it is general that a safety margin is greatly provided when generating the ATO speed profile to prevent the emergency braking from happening during train operation. Therefore, there is no way but to adopt an operation method based on a conservative viewpoint where a gap between a set value and an allowable limit value is enlarged. That is, there is no way but to allow a train to run at a low speed for fear of an emergency braking being possibly performed, even if the train can run at a faster speed.

Thus, the conventional train operation system suffers from disadvantages in that a train operation frequency at a relevant line is reduced to decrease operational efficiency in the economic viewpoint.

SUMMARY OF THE DISCLOSURE

This section provides a general summary of the disclosure, and is not a comprehensive disclosure of its full scope or all of its features.

Exemplary aspects of the present disclosure are to substantially solve at least the above problems and/or disadvantages and to provide at least the advantages below. Accordingly, an aspect of the present disclosure provides an apparatus for controlling speed in railway vehicles configured to reduce a train speed in advance before an ATP system activates an emergency brake of the train by predicting in advance a time that remains until the train exceeds an ATP speed limit during ATO (Automatic Train Operation).

It should be emphasized, however, that the present disclosure is not limited to a particular disclosure, as explained above. It should be understood that other technical subjects not mentioned herein may be appreciated by those skilled in the art.

In one general aspect of the present disclosure, there is provided an apparatus for controlling speed in railway vehicles, the apparatus comprising:

a first controller configured to estimate a future train speed and to determine a control input (first speed control) configured to control a train speed based on a TTSLC {Time-To-Speed-Limit Crossing, a time taken by a train from a current time to exceed an ATP (Automatic Train Protection) speed profile, which is an ATP speed limit};

a second controller configured to determine a control input (second speed control) configured to control the train speed based on a difference between the ATP speed profile and an actual train speed; and a selector configured to select the first speed control or the second speed control in response to the TTSLC and to output the selection to the train.

In some exemplary embodiments, the first controller may include a first estimation unit configured to estimate a current train speed through a non-linear observer using a train data including a propulsive force, a braking force and an acceleration of the train, and a track data including a track curvature and a track gradient, a second estimation unit configured to estimate a train future speed using the estimated current train speed, a calculation unit configured to calculate the TTSLC through a time when the train exceeds an ATP speed profile when the train maintains a current acceleration/deceleration state, and a third controller configured to output the first speed control using the calculated TTSLC.

In some exemplary embodiments, the first estimation unit may include a first generation unit configured to generate a dynamic model of the train using the train data and the track data, a design unit configured to design the non-linear observer based on the dynamic data, train data and the track data, and a third estimation unit configured to estimate a current train speed based on the acceleration through the non-linear observer.

In some exemplary embodiments, the non-linear observer may include an extended Kalman filter.

In some exemplary embodiments, the third estimation unit may include estimation of a train speed at current step using the train speed and track data of previous step, estimation of acceleration at current step using the estimated train speed, the train data at the current step and track data, obtainment of an estimation error using a difference between the acceleration included in the train data at the current step and the estimated acceleration, prediction of estimation error covariance at the current step using an error covariance at previous step, a process noise covariance, and a process Jacobian matrix, obtainment of a Kalman filter gain at the current step using the predicted estimation error covariance, a noise covariance measured at the current step and a Jacobian matrix of measurement variable, calibration of the predicted estimation error covariance using the Kalman filter gain, and estimation of the current speed by calibration of the predicted train speed using the estimation error and the Kalman filter gain.

In some exemplary embodiments, the second estimation unit may use the dynamics model generated by the first generation unit for estimation of the future speed.

In some exemplary embodiments, the first speed control may be a value in which a control gain is divided by the TTSLC.

In some exemplary embodiments, the second controller may include a second generation unit configured to generate an ATO speed profile using the ATP speed profile, a third generation unit configured to generate a speed error, which is a difference between the ATO speed profile and an actual train speed, and a fourth controller configured to output a second speed control by performing a PI (Proportionate Integral) control based on the speed error.

In some exemplary embodiments, the second speed control may be a sum in which a multiplication of the speed error by a proportionate gain and a multiplication of integration of the speed error by an integration gain are added.

In some exemplary embodiments, the selection unit may select and output the first speed control when the TTSLC is less than a set value, and selects and outputs the second speed control when the TTSLC is greater than the set value.

The apparatus for controlling speed in railway vehicles according to the exemplary embodiments of the present disclosure has an advantageous effect in that a train can be safely operated by predicting a future train speed, calculating in real time a TTSLC configured to predict after which time the train can exceed an ATP speed limit when the train maintains a current propulsive force or a braking force, and by providing a separate service brake before the train speed reaches the ATP speed limit.

Another advantageous effect is that train operation delay can be minimized by preventing generation of emergency braking caused by exceeded ATP speed limit from occurring, using a predicted future speed by predicting the train future speed.

Still another advantageous effect is that a minimum safety margin is provided when generating ATO speed profile to further increase a train speed during operation of the train, resultantly increasing operation frequency of the train and enhancing availability of train.

Other exemplary aspects, advantages, and salient features of the disclosure will become more apparent to persons of ordinary skill in the art from the following detailed description, which, taken in conjunction with the annexed drawings, discloses exemplary embodiments of the invention.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

It is to be understood that both the foregoing general description and the following detailed description of the present disclosure are exemplary and explanatory and are intended to provide further explanation of the disclosure as claimed.

DETAILED DESCRIPTION

Various exemplary embodiments will be described more fully hereinafter with reference to the accompanying drawings, in which some exemplary embodiments are shown. The present inventive concept may, however, be embodied in many different forms and should not be construed as limited to the example embodiments set forth herein. Rather, the described aspect is intended to embrace all such alterations, modifications, and variations that fall within the scope and novel idea of the present disclosure.

The present disclosure relates to a train speed limit of ATO, which is an automatic train operation apparatus, and employs a model-based observer design to predict a future train speed, calculates when the train will exceed an ATP speed limit after such and such seconds, and prevents the train from being confronted with a dangerous situation by performing a service braking operation, before the train exceeds the speed limit to allow being emergently braked.

That is, a TTSLC {Time-To-Speed-Limit Crossing, a time when the train exceeds an ATP (Automatic Train Protection) speed limit} is defined, and the TTSLC is calculated in real time while the train is running, and when the TTSLC is greater than a set value, the train speed is controlled based on profile, and when the TTSLC is smaller than a set value, the train speed is controlled based on the TTSLC to prevent the train from being emergently braked.

Now, exemplary embodiments of the present disclosure will be described with reference to the accompanying drawings.

Figure 1:
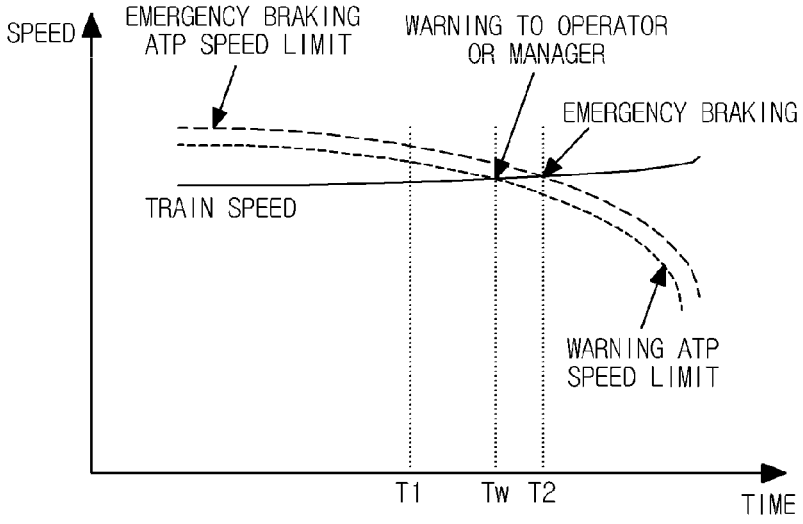
FIG. 1 (PRIOR ART)
FIG. 1 is a graph illustrating control of train speed according to prior art.
Figure 2:
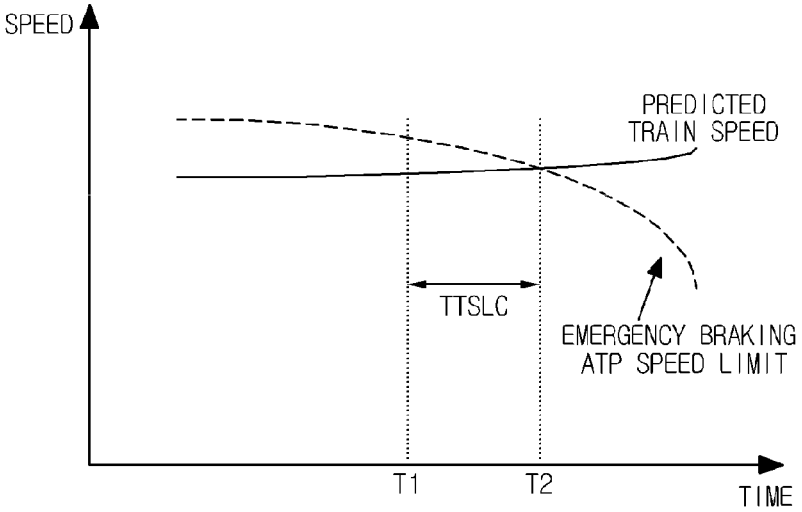
FIG. 2 is an exemplary graph illustrating the definition of TTSLC used in the present disclosure.

FIG. 2 is an exemplary graph illustrating the definition of TTSLC used in the present disclosure.

Referring to FIG. 2, it is assumed that a current time is T1, and a time exceeding an ATP speed limit is T2, and a TTSLC used in the present disclosure is a difference between T2 and T1.

Figure 3:
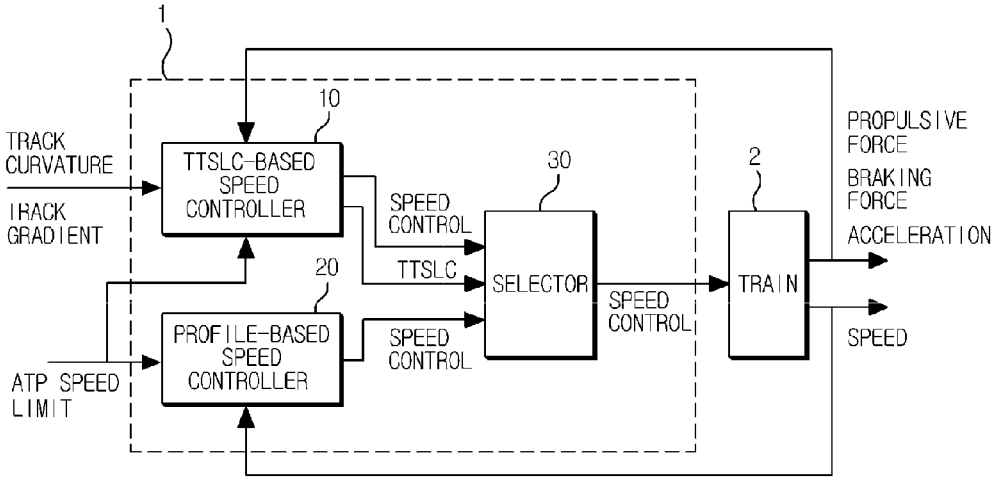
FIG. 3 is a block diagram illustrating an apparatus for controlling speed in railway vehicles according to an exemplary embodiment of the present disclosure.

FIG. 3 is a block diagram illustrating an apparatus for controlling speed in railway vehicles according to an exemplary embodiment of the present disclosure.

Referring to FIG. 3, an apparatus (1) for controlling speed in railway vehicles according to an exemplary embodiment of the present disclosure (hereinafter referred to as "apparatus") may include a TTSLC-based speed controller (10), a profile-based speed controller (20), and a selection unit (30).

The TTSLC-based speed controller (10) may determine a control input configured to control a train speed by estimating a train (2) future speed using a track data including a track curvature and a track gradient, and a train data including a train propulsive force, braking force and acceleration, and by calculating TTSLC, and based thereon.

The profile-based speed controller (20) may determine a control input based on a speed error, which is a difference between a profile speed and a current train speed, using ATP speed limit and the train speed.

The selection unit (30) may determine whether to transmit an output of the TTSLC-based speed controller (10) to the train (2) or to transmit an output of the profile-based speed controller (20) to the train (2).

Hereinafter, each element will be described in detail.

Figure 4:
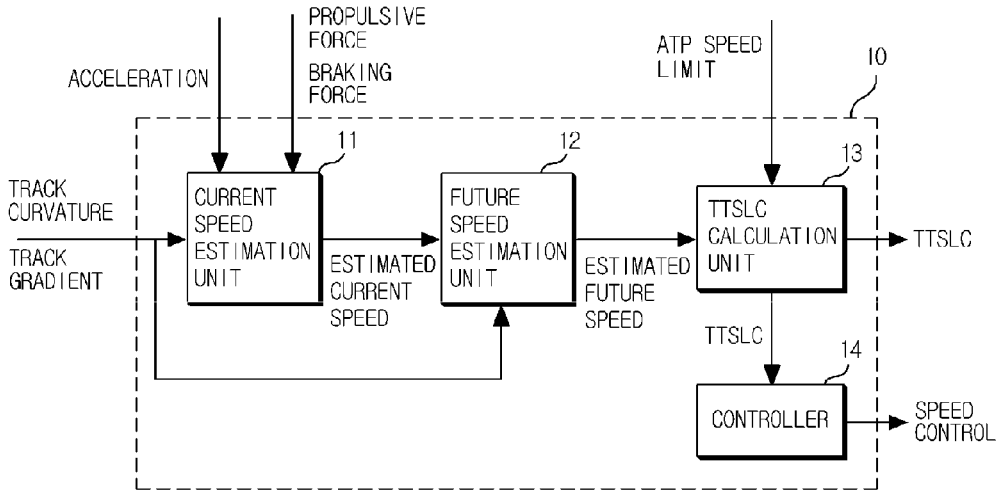
FIG. 4 is a detailed block diagram illustrating a TTSLC-based speed controller of FIG. 3 according to an exemplary embodiment of the present disclosure.

FIG. 4 is a detailed block diagram illustrating a TTSLC-based speed controller of FIG. 3 according to an exemplary embodiment of the present disclosure.

Referring to FIG. 4, the TTSLC-based speed controller (10) may include a current speed estimation unit (11), a future speed estimation unit (12), a TTSLC calculation unit (13) and a controller (14).

The current speed estimation unit (11) may estimate a current train (2) speed through a non-linear observer, using train data including a propulsive force, braking force and acceleration measurable from a sensor mounted on the train (2), and a track data including a track curvature set up as database and track gradient.

Figure 5:
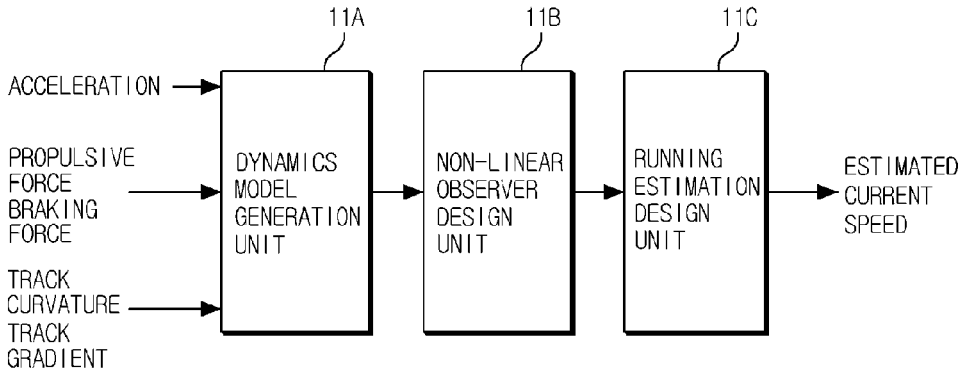
FIG. 5 is a detailed block diagram illustrating a current speed estimation unit of FIG. 4 according to an exemplary embodiment of the present disclosure.

FIG. 5 is a detailed block diagram illustrating a current speed estimation unit (11) of FIG. 4 according to an exemplary embodiment of the present disclosure.

Referring to FIG. 5, the current speed estimation unit (11) may include a dynamics model generation unit (11A), a non-linear observer design unit (11B), and a running speed estimation unit (11C).

The dynamics model generation unit (11A) may generate a dynamics model based on a train longitudinal model, by receiving an acceleration from an acceleration sensor (not shown), a propulsive force from a propulsion device (not shown), a braking force from a braking device (not shown), a track curvature set up as database, and a track gradient. First, the longitudinal dynamics model of the train (2) may be obtained from the following equation using Newton's second law, if movement of the train (2) of crosswise directions is small enough to be disregarded.

$$m\frac{dv}{dt} = T_e - T_b - R_r - R_g R_c + w \quad \text{[Equation 1]}$$

where, m is a train equivalent mass of the train (2), v is a train longitudinal speed of the train (2), Te is a tractive force, Tb is a braking force, Rr is a running resistance formed by adding a rolling resistance and an aerodynamic drag. Furthermore, Rg is a grade resistance, and Rc is a curving resistance. Still furthermore, w, which is a process noise, may be defined as modeling error or a disturbance.

The train (2) equivalent mass m is defined by an imagination of a lumped mass, although the train (2) is substantially formed by connecting several rolling stocks. The tractive force Te and the braking force Tb are respectively received from a tractive device (not shown) and a braking device (not shown) of the train (2).

The train (2) running resistance Rr is expressed by a sum of the rolling resistance and aerodynamic drag, and may be modeled by the following quadratic equation to speed.

$$R_r = c_1 + c_2 v + c_3 v^2 \quad \text{[Equation 2]}$$

where $c_1$, $c_2$ and $c_3$ are respectively constants, the quadratic term to the speed is an equation to aerodynamic drag, linear and constant terms to speed are expression to rolling resistance.

The grade resistance Rg may be expressed by a relational expression to the train equivalent mass m and grade level of the train as shown in the following Equation 3.

$$R_g = mg\theta \quad \text{[Equation 3]}$$

where g is a gravitational acceleration, θ is gradient angle. That is, if there is almost no inclination, the grade resistance Rg may be disregarded.

Furthermore, the curving resistance Re is a function to curvature radius, and may be expressed by the following Equation 4.

$$R_c = c_4/r \quad \text{[Equation 4]}$$

where, c4 is a constant, r is a curvature radius.

When Equations 2 to 4 are substituted for Equation 1, it may be defined by the following Equation 5

$$m\frac{dv}{dt} = T_e - T_b - c_1 - c_2 v - c_3 v^2 - mg\theta - c_4/r + w \quad \text{[Equation 5]}$$

An acceleration received from the acceleration sensor (not shown) may be modeled by the following Equation 6.

$$y = \frac{1}{m}[T_e - T_b - c_1 - c_2 v - c_3 v^2 - mg\theta - c_4 / r] + d \quad \text{[Equation 6]}$$

where, y is an acceleration measured by the acceleration sensor, and d is a sensor noise. When acceleration is measured by an acceleration sensor, a sensor noise may be included, and when the acceleration included with the sensor noise is integrated to determine the speed, accuracy of running speed may be degraded by the sensor noise.

Discretization of the longitudinal dynamics model of train (2) may be expressed by the following Equation 7.

$$v(k) = v(k-1) + \frac{\Delta T}{m}[T_e(k-1) - T_b(k-1) - c_1 - c_2 v(k-1) - c_3 v(k-1)^2 - mg\theta(k-1) - c_4 / r(k-1)] + w_d(k-1) \quad \text{[Equation 7]}$$

where, ΔT is a sampling period, and wd(k−1) is a discretized disturbance at k−1 step.

Referring to FIG. 5, the non-linear observer design unit (11B) may design a non-linear observer for estimating a running speed based on dynamics model of a train, a train data received form a sensor and a track data, and may use the Equation 7.

Various types of observer capable of estimating state variables in a non-linear system are available, but the present disclosure will use a simply designable extended Kalman filter in the present disclosure. However, the extended Kalman filter is just an example, and it should be apparent to the skilled in the art that use of other observers than the extended Kalman filter as an observer design for estimating the train speed is not ruled out.

A speed estimation using the extended Kalman filter may be expressed by the following Equations.

$$\hat{v}(k \mid k-1) = \hat{v}(k-1 \mid k-1) + \frac{\Delta T}{m}[-c_2 \hat{v}(k-1 \mid k-1) - c_3 \hat{v}(k-1 \mid k-1)^2] + \frac{\Delta T}{m}[T_e(k-1) - T_b(k-1) - c_5] \quad \text{[Equation 8]}$$

$$P(k \mid k-1) = F(k-1)P(k-1 \mid k-1)F(k-1)^T + Q(k-1) \quad \text{[Equation 9]}$$

$$\hat{y}(k \mid k-1) = \frac{1}{m}[T_e(k) - T_b(k) - c_5 - c_2 \hat{v}(k \mid k-1) - c_3 \hat{v}(k \mid k-1)^2] \quad \text{[Equation 10]}$$

$$L(k) = P(k \mid k-1)H(k)^T (H(k)P(k \mid k-1)H(k)^T + R(K))^{-1} \quad \text{[Equation 11]}$$

$$\hat{v}(k \mid k) = \hat{v}(k \mid k-1) + L(k)(y(k) - \hat{y}(k \mid k-1)) \quad \text{[Equation 12]}$$

$$P(k \mid k) = (I - L(k)H(k))P(k \mid k-1) \quad \text{[Equation 13]}$$

where, L(k) is a gain of Kalman filter, and y(k) is an acceleration of a train (2) obtained from an acceleration sensor (not shown) attached to the train (2). Q(k+1) and R(k) are error covariance by a process noise and a sensor noise. Furthermore, F (k+1) is a Jacobian matrix of process model expressed by the Equation 8 relative to state variable, and H(k) is a Jacobian matrix relative to state variable of measurement variable y(k).

The running speed estimation unit (11C) can estimate a train running speed using the non-linear observer thus designed, and estimate a current train speed based on the acceleration using the extended Kalman filter according to sequential calculation of Equations 8 to 13, the details of which may be explained as below:

1) First, a train speed at k step (current step) is predicted using braking force and track data at k−1 step (previous step) (Equation 8).
2) A measurement variable y(k), which is an acceleration at k step using the train speed obtained at the predicted k step obtained from 1) and the braking force and track data at k step (Equation 10).
3) An estimation error, which is a difference between a measurement value and an estimation value, is obtained, using the measurement variable predicted by k step obtained from 2) and a measurement value measured by an acceleration sensor (Equation 12).
4) An estimation error covariance at k−1 step is predicted, using an error covariance at k−1 step, a process noise covariance and a process Jocobian matrix (Equation 9).
5) A Kalman filter gain at k-step is obtained using the estimation error covariance at k−1 step predicted at 4), the measurement noise covariance at k step and the measurement variable Jocobian matrix at k step (Equation 11).
6) The estimation error covariance at k step predicted at 4) is corrected (calibrated) using the Kalman filter gain at k step obtained at 5) (Equation 13).
7) A current speed at k step is estimated by calibrating the train speed estimation value at k step predicted at 1), using the estimation error relative to the measurement variable at k step obtained at 3) and the Kalman filter gain obtained at 5).

That is, the running speed estimation unit (11C) according to the present disclosure predicts a train speed at next step using the braking force at previous step, the track curvature and track gradient, and corrects (calibrates) the predicted train speed using an estimation error between the acceleration received from the acceleration sensor and measurement variable estimated based on the predicted train speed. At this time, the correction is made by a method in which the estimation error is added by a value multiplied by the estimation error as much as the Kalman filter gain that is added by the predicted train speed (Equation 12). The current train speed thus estimated becomes a value robust to the sensor noise or disturbances.

Meantime, the future speed estimation unit (12) of FIG. 4 estimates a future train speed subsequent to n step, using the estimated current train speed. To this end, it is assumed that there is no change and constant in the tractive force and braking force applied to the current train. The dynamics model thus proposed for estimating the future train speed may be used. The train current speed subsequent to 1 step, 2 step and 3 step may be expressed by the following Equations.

$$\hat{v}(k+1) = \hat{v}(k \mid k) + \frac{\Delta T}{m}[c_2 \hat{v}(k \mid k) - c_3 \hat{v}(k \mid k)^2] + \frac{\Delta T}{m}[T_e(k) - T_b(k) - mg\theta(k) - c_4 / r(k)] \quad \text{[Equation 14]}$$

-continued $$\hat{v}(k+2)=\hat{v}(k+1)+\frac{\Delta T}{m}[c_2\hat{v}(k+1)-c_3\hat{v}(k+1)^2]+\frac{\Delta T}{m}[T_e(k)-T_b(k)-mg\theta(k)-c_4/r(k)] \quad \text{[Equation 15]}$$

$$\hat{v}(k+3)=\hat{v}(k+2)+\frac{\Delta T}{m}[c_2\hat{v}(k+2)-c_3\hat{v}(k+2)^2]+\frac{\Delta T}{m}[T_e(k)-T_b(k)-mg\theta(k)-c_4/r(k)] \quad \text{[Equation 16]}$$

In the similar way, a current train speed subsequent to n−1 step and n step may be estimated by the following Equations.

$$\hat{v}(k+n-1)=\hat{v}(k+n-2)+\frac{\Delta T}{m}[c_2\hat{v}(k+n-2)-c_3\hat{v}(k+n-2)^2]+\frac{\Delta T}{m}[T_e(k)-T_b(k)-mg\theta(k)-c_4/r(k)] \quad \text{[Equation 17]}$$

$$\hat{v}(k+n)=\hat{v}(k+n-1)+\frac{\Delta T}{m}[c_2\hat{v}(k+n-1)-c_3\hat{v}(k+n-1)^2]+\frac{\Delta T}{m}[T_e(k)-T_b(k)-mg\theta(k)-c_4/r(k)] \quad \text{[Equation 18]}$$

Sequential use of Equations 14 to 18 may predict a current train speed at k+n step using the train data at k step. To wrap up, a current train speed may be estimated, using the train data including train acceleration, propulsive force and braking force at kth step, and a future speed, which is a future train speed at k+nth step can be predicted, using the estimation value and dynamics model.

The TTSLC calculation unit (13) of FIG. 4 calculates at which time point the train has exceeded the set ATP speed profile when it is assumed that the train maintains the current acceleration/deceleration states. It is assumed that the current train speed exceeds the ATP speed limit at the nth step.

$$\hat{v}(k+n)\geq v_{limit} \quad \text{[Equation 19]}$$

where, $v_{limit}$ is an ATP speed limit for braking. If k is a current time point, the current train speed after the n step means that the train exceeds the ATP speed limit. At this time, the TTSLC may be calculated by the following Equation.

$$TTSLC=n\times\Delta T \quad \text{[Equation 20]}$$

where, unit of TTSLC is second, and AT is a sampling period.

The controller (14) may output a speed control in the following manner using the TTSLC thus calculated.

$$u=K_{TTSLC}/TTSLC \quad \text{[Equation 21]}$$

where, $K_{TTSLC}$ is a control gain. That is, a control input transmitted to the train may be changed in reverse proportionate to the TTSLC, and when the TTSLC is very high, that is, when a remaining time until the ATP speed limit is exceeded is very huge, a control value is near zero, and when the TTSLC is very small, that is, when a remaining time until the ATP speed limit is exceeded is very small, a control value nears to 100% (full service braking).

Figure 6:
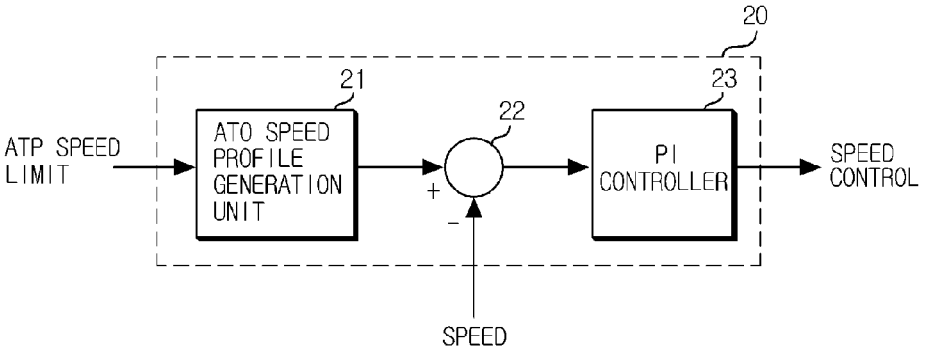
FIG. 6 is a detailed block diagram illustrating a profile-based speed controller of FIG. 3 according to an exemplary embodiment of the present disclosure.

Now, the profile-based speed controller (20) of FIG. 3 will be described. FIG. 6 is a detailed block diagram illustrating a profile-based speed controller (20) of FIG. 3 according to an exemplary embodiment of the present disclosure.

Referring to FIG. 6, the profile-based speed controller (20) may include an ATO speed profile generation unit (21), an error generation unit (22) and a PI (Proportional Integral) controller (23). The ATO speed profile generation unit (21) may generate an ATO speed profile using the ATP speed limit. The generation of ATO speed profile is well known to the skilled in the art, such that no more further detailed explanation will be made thereto.

The error generation unit (22) may generate an error, which is a difference between a speed of ATO speed generated by the ATO speed profile generation unit (21) and an actual speed of a train received from a train speed sensor (not shown). The PI (Proportional Integral) controller (23) may determine a speed control input value based on the error generated by the error generation unit (22). The PI control is well known to the skilled in the art, such that no more further detailed explanation will be made thereto.

The speed control outputted by the PI controller (23) may be determined by the following Equation, based on a speed error, which is a difference between the ATO speed profile at the current train position and an actual train speed.

$$u=K_P\cdot e+K_I\cdot\int e \quad \text{[Equation 22]}$$

where, e is a speed error, and $\int e$ is an integration of speed error. Furthermore, $K_P$ and $K_I$ are proportional gain and integration gain.

The selection unit of FIG. 3 may determine whether to transmit an output of the TTSLC based speed controller (10) to the train in response to the TTSLC determined by the TTSLC calculation unit (13), or to transmit an output of the profile-based speed controller (20) to the train. That is, when the calculated TTSLC is less than a set value, the output of the TTSLC based speed controller (10) may be determined as the ATO output, and when the calculated TTSLC is more than the set value, the output of the profile based speed controller (20) may be determined as the ATO output.

The operation of the selection unit (30) may be expressed by the following Equation.

$$\text{if } TTSLC\leq T_{threshold}$$

$$u=K_{TTSLC}/TTSLC$$

$$\text{else}$$

$$u=K_P\cdot e+K_I\cdot\int e \quad \text{[Equation 23]}$$

where, $T_{threshold}$ is a set value for selection of the selection unit (30).

That is, according to the present invention, determination may be made as to whether to perform the profile based PI control or to perform the TTSLC based control by calculating the TTSLC in real time when the train is running.

Figure 7:
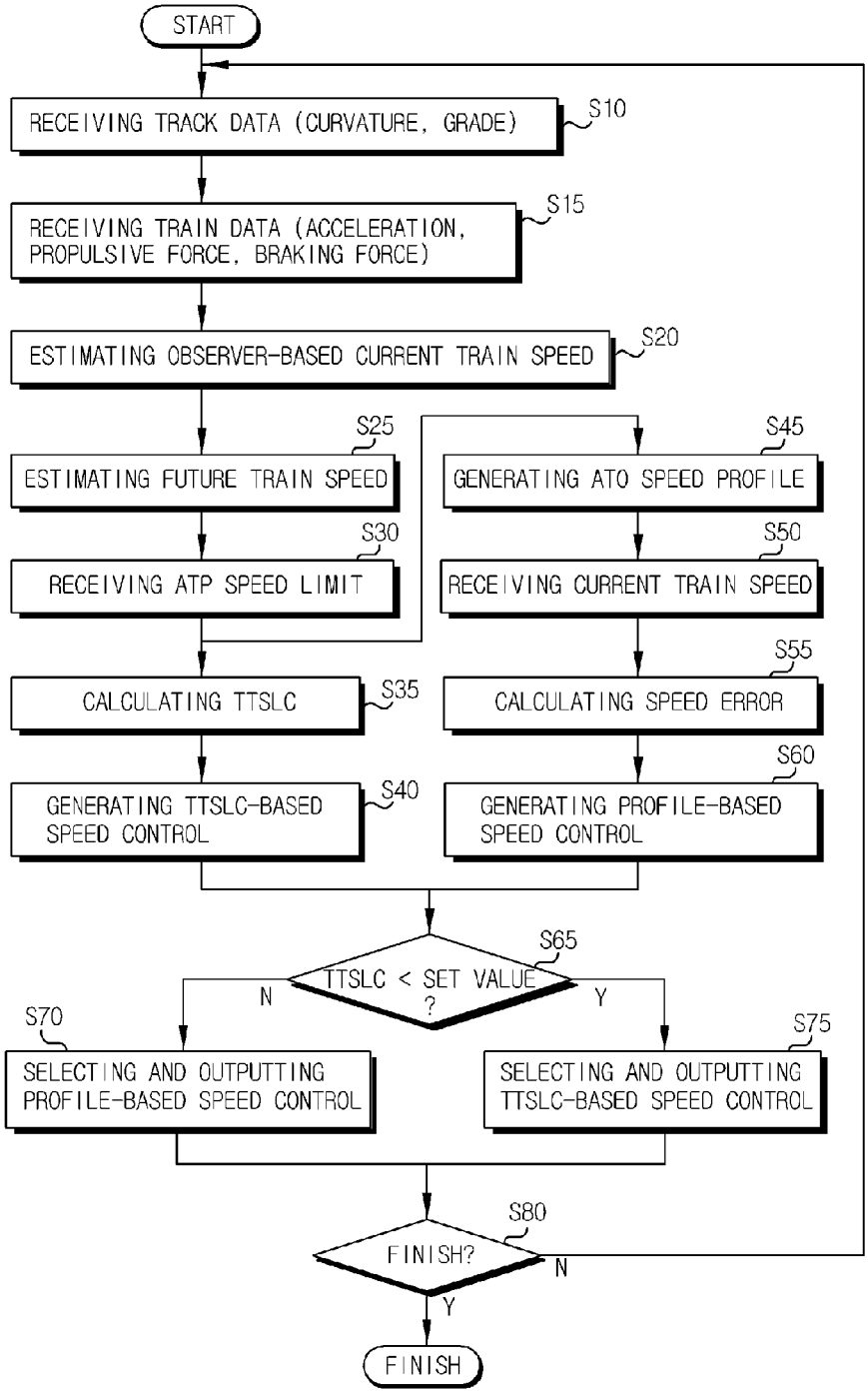
FIG. 7 is a flowchart illustrating a method for controlling a train speed according to an exemplary embodiment of the present disclosure.

FIG. 7 is a flowchart illustrating a method for controlling a train speed according to an exemplary embodiment of the present disclosure.

Referring to FIG. 7, the method for controlling train speed according to the present disclosure may include receiving a track data set up as database including track curvature and track gradient (S10), receiving the acceleration from an acceleration sensor (not shown), and receiving a propulsive force from a propulsion device (not shown) and receiving a braking force from a braking device (not shown) (S15).

The current speed estimation unit (11) may form the dynamics model of a train from the track data and train data, and may estimate a current train speed through the non-linear design based on the dynamics model (S20). The estimation of current speed has been already explained through the Equations 1 to 13, such that no more redundant explanation thereto will be made.

The future speed estimation unit (12) may estimate a future speed after n step of the train, using the current propulsive force or braking force information (S25). The estimation of future speed has been already explained through the Equations 14 to 18, such that no more redundant explanation will be made thereto.

Subsequently, the TTSLC calculation unit (13) may receive the ATP speed limit from the train (2)(530) to calculate TTSLC based on the estimated future speed (S35). Furthermore, the controller (14) may generate a speed control through the TTSLC based control algorithm (S40). Meanwhile, the ATO speed profile generation unit (21) may generate an ATO speed profile using the ATP speed limit (S45), and the error generation unit (22) may calculate (S55) a speed error, which is a difference between the ATP speed profile and the actual train speed, by receiving (S50) a current train speed from a tachometer (not shown). Thereafter, the PI controller (23) may generate a speed control by performing a PI control based on the speed error (S60).

The selection unit (30) may select and output a profile-based speed control (S70) when the calculated TTSLC is greater than a set value by comparing the calculated TTSLC with the set value (S65), and may select and output a TTSLC based speed control (S75) when the TTSLC is smaller than the set value. All the above steps may be repetitively performed until the control is finished (S80).

The apparatus for controlling speed in railway vehicles according to the exemplary embodiments of the present disclosure has an industrial applicability in that a train can be safely operated by predicting a future train speed, calculating in real time a TTSLC configured to predict after which time the train can exceed an ATP speed limit when the train maintains a current propulsive force or a braking force, and by providing a separate service brake before the train speed reaches the ATP speed limit.

Another industrial applicability is that train operation delay can be minimized by preventing generation of emergency braking caused by exceeded ATP speed limit from occurring, using a predicted future speed by predicting the train future speed.

Still another industrial applicability is that a minimum safety margin is provided when generating ATO speed profile to further increase a train speed during operation of the train, resultantly increasing operation frequency of the train and enhancing availability of train.

The above-mentioned apparatus for controlling speed in railway vehicles according to the present disclosure may, however, be embodied in many different forms and should not be construed as limited to the embodiments set forth herein. Thus, it is intended that embodiments of the present disclosure may cover the modifications and variations of this disclosure provided they come within the scope of the appended claims and their equivalents. While particular features or aspects may have been disclosed with respect to several embodiments, such features or aspects may be selectively combined with one or more other features and/or aspects of other embodiments as may be desired.

What is claimed is:

1. An apparatus for controlling speed in railway vehicles, the apparatus comprising:

a first controller configured to estimate a future train speed and to determine a first speed control to control a train speed based on a TTSLC (Time-To-Speed-Limit Crossing) that is a time taken by a train from a current time to exceed an ATP (Automatic Train Protection) speed profile that is an ATP speed limit;

a second controller configured to determine a second speed control to control the train speed based on a difference between the ATP speed profile and actual train speed; and a selection unit configured to select the first speed control or the second speed control in response to the TTSLC and to output the selection to the train, wherein the second controller includes a first generation unit configured to generate an ATO (Automatic Train Operation) speed profile using the ATP speed profile, a second generation unit configured to generate a speed error that is a difference between the ATO speed profile and the actual train speed, and a third controller configured to output the second speed control by performing a PI (Proportionate Integral) control based on the speed error, wherein the first controller includes:

a first estimation unit configured to estimate current train speed through a non-linear observer using train data including a propulsive force, a braking force and an acceleration of the train and to estimate track data including a track curvature and a track gradient;

a second estimation unit configured to estimate future train speed using the estimated current train speed;

a calculation unit configured to calculate the TTSLC through a time when the train exceeds the ATP speed profile while the train maintains a current acceleration or deceleration; and a fourth controller configured to output the first speed control using the calculated TTSLC, wherein the first estimation unit includes:

a third generation unit configured to generate a dynamic model of the train using the train data and the estimated track data;

a design unit configured to design the non-linear observer based on the generated dynamic model, the train data and the estimated track data; and a third estimation unit configured to estimate the current train speed through the non-linear observer based on the current acceleration, wherein the third estimation unit performs:

estimation of the current train speed using previous train speed and previous track data;

estimation of the current acceleration using the estimated current train speed, current train data and the previous track data;

determination of an estimation error using a difference between acceleration included in the current train data and the estimated current acceleration;

prediction of current estimation error covariance using previous error covariance, process noise covariance, and a process Jacobian matrix;

determination of current Kalman filter gain using the predicted current estimation error covariance, a current measured noise covariance and a Jacobian matrix of measurement variable;

calibration of the predicted current estimation error covariance using the determined current Kalman filter gain; and estimation of the current train speed by calibrating predicted train speed using the determined estimation error and the determined current Kalman filter gain.

2. The apparatus of claim 1, wherein the non-linear observer includes an extended Kalman filter.

3. The apparatus of claim 1, wherein the second estimation unit uses the generated dynamic model to estimate the future train speed.

4. The apparatus of claim 1, wherein the first speed control is determined by dividing a control gain by the TTSLC.

5. The apparatus of claim 1, wherein the second speed control is determined by adding a multiplication of the generated speed error by a proportionate gain and a multiplication of integration of the generated speed error by an integration gain.

6. The apparatus of claim 1, wherein the selection unit is further configured to select and output the first speed control when the TTSLC is less than a set value and to select and output the second speed control when the TTSLC is greater than the set value.

* * * * *